US006392353B1

(12) United States Patent
Smulders et al.

(10) Patent No.: US 6,392,353 B1
(45) Date of Patent: May 21, 2002

(54) CIRCUIT DEVICE FOR DIMMING A DISCHARGE LAMP

(75) Inventors: Herman Adrianus Godefridus Severinus Smulders; Johannes Hendrik Wessels, both of Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 28 days.

(21) Appl. No.: 09/703,422

(22) Filed: Nov. 1, 2000

(30) Foreign Application Priority Data

Nov. 2, 1999 (EP) ..... 99203608

(51) Int. Cl.[7] ..... H05B 37/02

(52) U.S. Cl. ..... 315/149; 315/224; 315/307; 315/308; 315/DIG. 4

(58) Field of Search ..... 315/149, 150, 315/151, 159, 224, 308, 307, 291, 362, DIG. 4, 360

(56) References Cited

U.S. PATENT DOCUMENTS 5,373,218 A * 12/1994 Konopka et al. ..... 315/209 R 5,821,702 A * 10/1998 Vegter ..... 315/224

FOREIGN PATENT DOCUMENTS

| | | | |
|---|---|---|---|
| EP | 0508526 A1 | 3/1992 | ..... H05B/41/38 |
| WO | WO9425912 | 11/1994 | ..... G05F/1/00 |
| WO | WO9608125 | 3/1996 | ..... H05B/41/36 |

* cited by examiner

*Primary Examiner*—Don Wong
*Assistant Examiner*—Chuc D. Tran

(57) ABSTRACT

The light output of a lighting arrangement is adjustable at two levels by, for example, "toggling". During a predetermined time interval immediately after ignition, the lamp is supplied with additional power to heat up. Immediately after stationary conditions have been reached, the light output is automatically adjusted to the lowest of the two levels. During the predetermined time interval, the light output is also controlled so as to be at the lowest of the two levels, so that relatively large changes in the level of the light output during the predetermined time interval, and immediately after it, are prevented.

7 Claims, 1 Drawing Sheet

CIRCUIT DEVICE FOR DIMMING A DISCHARGE LAMP

BACKGROUND OF THE INVENTION

The invention relates to a circuit device for feeding a discharge lamp, comprising

- input terminals for connecting the circuit device to a supply-voltage source,
- a ballast circuit for generating a lamp current from a supply voltage supplied by the supply-voltage source,
- a circuit part I, which is coupled to the ballast circuit, for controlling the power consumed by the discharge lamp in dependence upon a dim signal,
- a circuit part II, which is coupled to the circuit part I, for generating the dim signal, which dim signal has a first value immediately after the ignition, which value corresponds, during stationary operation, to a first value of the power consumed by the discharge lamp, and is maintained at a second value after a predetermined time interval, which second value corresponds, during stationary lamp operation, to a second value of the power consumed by the discharge lamp, which second value is lower than the first value of the power consumed by the discharge lamp,
- a circuit part V which enables a user to set a dim signal to the second value or a third value which, during stationary lamp operation, corresponds to a third value of the power consumed by the discharge lamp, which third value is higher than the second value of the power consumed by the discharge lamp.

Such a circuit arrangement is disclosed in WO 94/25912. In the known circuit device, the first value of the dim signal corresponds to rated power. During the predetermined time interval, this first value does not change. Both the circuit arrangement and the discharge lamp fed by means of the circuit arrangement heat up during the predetermined time interval to a temperature at which stable lamp operation in a dimmed state is possible. After the predetermined time interval, the circuit part II sets the value of the dim signal to a second value which corresponds to a second value of the power consumed by the discharge lamp, at which second value the discharge lamp bums in a dimmed state. An important advantage of the known circuit device resides in that the luminous flux of the lamp adjusts to a dimmed level without the interference of a user, so that the power consumed by the discharge lamp is relatively low. If the luminous flux at the dimmed level is found satisfactory by the user, a substantial energy saving is obtained in this manner. In practice, it has been found that if the discharge lamp connected to the circuit device is comparatively new, the luminous flux obtained when the discharge lamp burns at a dimmed level is found satisfactory by many users. As a result of ageing of the discharge lamp, however, the luminous flux at a given power is subject to deterioration. If the luminous flux at the dimmed level is found to be insufficient by the user, he can activate the circuit part V by "toggling" the main switch which connects the circuit device to the supply voltage source. As a result, said circuit part V then adjusts the dim signal to a third value, which corresponds, in the known circuit device, to the rated lamp power and to the maximum luminous flux of the discharge lamp.

A drawback of the known circuit device, however, resides in that the luminous flux of the discharge lamp fed by means of the circuit device changes continuously during the predetermined time interval. This can be attributed to the fact that the temperature of the discharge lamp changes continuously during the predetermined time interval. In addition, the luminous flux changes abruptly towards the end of the predetermined time interval, which can be attributed to the fact that the circuit part II abruptly sets the dim signal to the second value. These comparatively large changes of the luminous flux within a comparatively short period of time are generally perceived as disturbing by a user.

SUMMARY OF INVENTION

It is an object of the invention to provide a circuit device which enables a substantial saving in energy to be obtained without the luminous flux of the discharge lamp fed by the circuit arrangement being subject to large changes within a comparatively short period of time.

To achieve this, a circuit device of the type mentioned in the opening paragraph is characterized in accordance with the invention in that, during the predetermined time interval, the dim signal is adjusted by the circuit part II in such a manner that, during the predetermined time interval, the luminous flux of the discharge lamp differs less than 25% from the luminous flux which, during stationary operation, corresponds to the second power consumed by the discharge lamp.

By virtue of the fact that the circuit part II continuously adapts the dim signal during the predetermined time interval, it is achieved that the luminous flux varies only to a very small degree. The level at which the luminous flux is maintained during the predetermined time interval is chosen to be equal to the luminous flux level which, under stationary conditions, corresponds to the second value of the dim signal, in this case the second value of the power consumed by the discharge lamp. As a result, it is achieved that the luminous flux is not subject to substantial change at the end of the predetermined time interval, but remains substantially constant instead. From the moment the discharge lamp is ignited and during the time the discharge lamp bums, the user of a discharge lamp in accordance with the invention continually observes a substantially constant quantity of light. It has been found that this is appreciated by users.

It has also been found that, preferably during the predetermined time interval, the dim signal is adapted by the circuit part II in such a manner that the luminous flux of the discharge lamp differs less than 10% during the predetermined time interval from the luminous flux which, during stationary operation, corresponds to the second power consumed by the discharge lamp.

The circuit part II of a circuit device in accordance with the invention may be provided with analog electronics to implement the desired time dependence of the dim signal during the predetermined time interval. In this manner, the circuit device can be made suitable for at least a first type of discharge lamp. If such a circuit device would be used in combination with a discharge lamp of a second type whose run-up behavior differs from the run-up behavior of the discharge lamp of the first type, it is possible that the luminous flux of the discharge lamp of the second type changes substantially during the predetermined time interval. For this reason, the circuit part II is provided, in a first embodiment of a circuit device in accordance with the invention, with

- a memory for storing dim-signal values for a number of instants in the predetermined time interval,
- a circuit part III for successively making the dim signal equal to the values stored in the memory.

The contents of the memory can be attuned to the properties of the type of discharge lamp fed by means of the circuit device. The circuit device can thus be made suitable for use in combination with a large number of different types of discharge lamps by adapting the contents of the memory. Good results have been achieved for embodiments of such a first preferred embodiment wherein the circuit part III comprises a microprocessor.

Good results have also been attained for embodiments of a circuit device in accordance with the invention, wherein the circuit part II is provided with a circuit part VI for controlling the luminous flux. This circuit part VI is preferably provided with

- a light sensor for generating a first signal which is a measure of the luminous flux of the discharge lamp,
- a comparator provided with a first and a second input, the first input being coupled to the light sensor,
- a circuit part IV coupled to the second input of the comparator for generating a reference signal which is a measure of the value of the luminous flux which, during stationary operation, corresponds to the second power consumed by the discharge lamp, and
- a control circuit coupled to an output of the comparator for generating a dim signal in dependence upon the first signal and the reference signal.

Via the comparator, the control circuit continuously adjusts the dim signal to such a value, during the predetermined time interval, that the luminous flux of the discharge lamp remains substantially constant. Also for these embodiments, it applies that they can be used in combination with discharge lamps having a different run-up behavior.

Preferably, the circuit part V is embodied so as to be activatable by means of interrupting the supply voltage. In this case, the dim signal can be given the second or the third value by a user by interrupting the supply voltage for a short period of time by means of the main switch which connects the supply voltage source to the circuit device.

These and other aspects of the invention will be apparent from and elucidated with reference to the embodiments described hereinafter.

DESCRIPTION OF THE PREFERRED EMBODIMENTS

Figure 1:
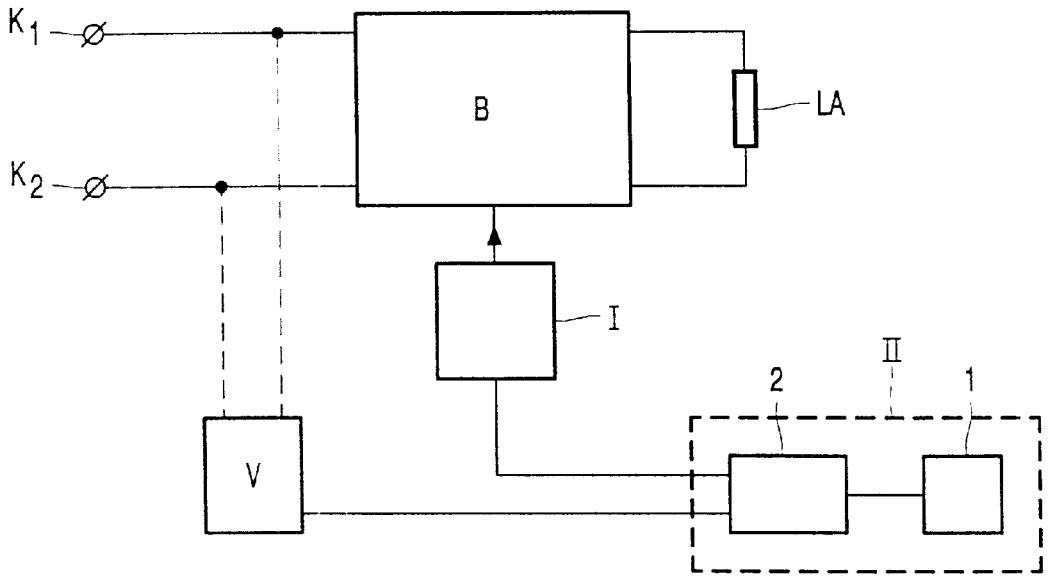
FIG. 1 shows a first example of a circuit device in accordance with the invention comprising a discharge lamp connected to the circuit device.

In FIG. 1, K1 and K2 are input terminals which are to be connected to a supply-voltage source. B is a ballast circuit for generating a lamp current from a supply voltage supplied by the supply-voltage source. For this purpose, respective inputs of the ballast circuit B are coupled to input terminals K1 and K2. A discharge lamp La is connected to the ballast circuit B. I is a circuit part for controlling the power consumed by the discharge lamp in dependence upon a dim signal. An output of the circuit part I is connected to an input of the ballast circuit B. II is a circuit part for generating the dim signal. An output of the circuit part II is connected to an input of circuit part I. In this example, the circuit part II comprises a circuit part III, which is formed by a microprocessor 2 and a memory 1 for storing the values of the dim signal for a number of successive instants in the predetermined time interval. The circuit part III is used to successively make the dim signal equal to the values stored in the memory. A first input of the microprocessor 2 is connected to an output of the memory 1. The circuit part V is a circuit part for adjusting the dim signal by a user. An output of the circuit part V is connected, for this purpose, to a second input of the microprocessor 2. To this end, respective inputs of the circuit part V are coupled to input terminals K1 and K2. This coupling is shown in FIG. 1 by means of dotted lines.

The operation of the example shown in FIG. 1 is described hereinbelow.

If the input terminals K1 and K2 are connected to a supply voltage source, ballast circuit B generates a lamp current which is fed to the discharge lamp La. The amplitude of the lamp current and hence the value of the power consumed by the discharge lamp La depends upon the dim signal generated by the circuit part II. Immediately after the discharge lamp has been ignited, the microprocessor 2 reads the first value of the dim signal from the memory 1, and a timer is started which forms part of the microprocessor 2. During a previously determined time interval, the timer generates a pulse at a predetermined repetition rate. At each pulse, a next value of the dim signal is read into the memory 1 by the microprocessor and passed on to the input of the circuit part I. The circuit part I controls the power consumed by the discharge lamp in dependence upon this dim signal. Since successive values of the dim signal are chosen in accordance with the run-up behavior of the discharge lamp La, it is achieved that the luminous flux of the discharge lamp La is maintained at a substantially constant level during the predetermined time interval. After the predetermined time interval has ended, the dim signal is maintained by the microprocessor 2 at a (second) value, which is the value last read from the memory 1 by the microprocessor 2. Since the predetermined time interval corresponds to the time necessary for the ballast circuit B and the discharge lamp La to reach stationary operating conditions, also after the predetermined time interval the luminous flux of the discharge lamp changes hardly. If a user should find the luminous flux of the discharge lamp insufficient, he can adjust a third value of the dim signal by activating the circuit part V, which third value corresponds to a higher value of the luminous flux than the second value of the dim signal. In the example shown in FIG. 1, the circuit part V can be activated by temporarily interrupting the supply voltage present between the input terminals by means of a main switch, which is not shown. Via the second input of the microprocessor 2, said microprocessor 2 is activated to read the third value of the dim signal into the memory 1 and pass it on to the input of the circuit part I. The circuit part I subsequently adjusts the power consumed by the discharge lamp to a higher (third) value, so that the luminous flux of the discharge lamp increases.

Figure 2:
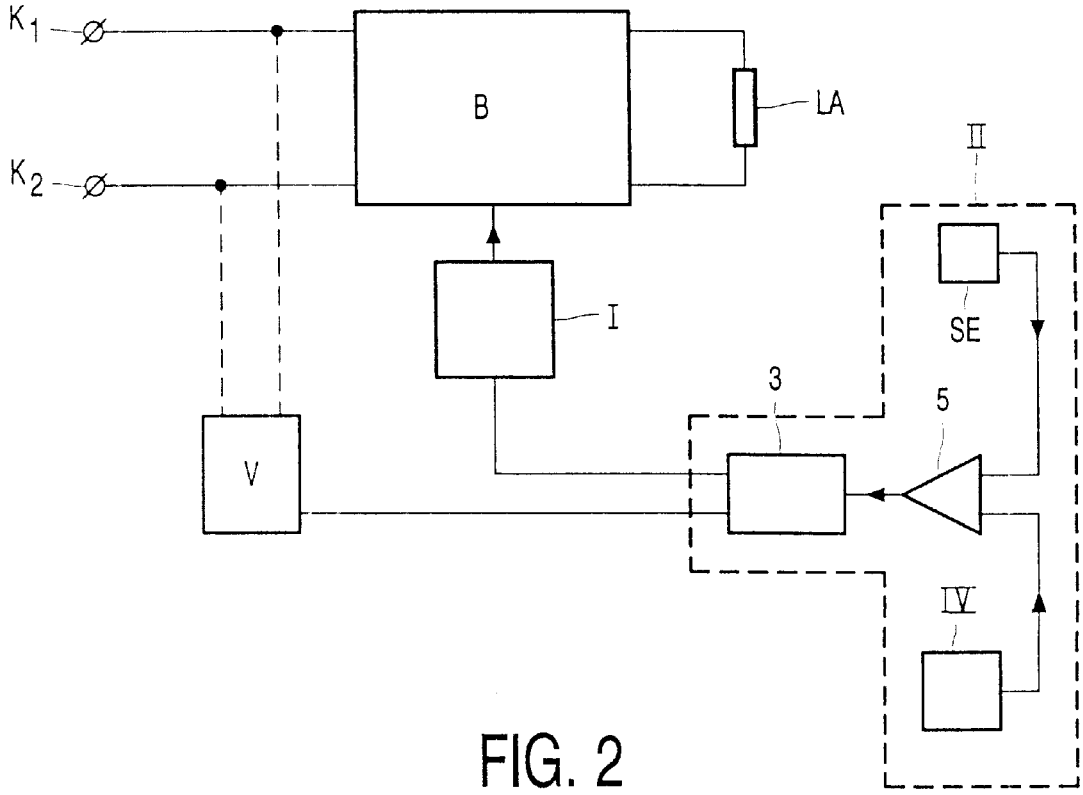
FIG. 2 shows a second example of a circuit device in accordance with the invention to which a discharge lamp is connected.

In the example shown in FIG. 2, circuit parts which correspond to circuit parts of the example shown in FIG. 1 bear the same reference numerals. The example shown in FIG. 2 only differs from that shown in FIG. 1 in that the circuit part II is differently embodied. Said circuit part II comprises a light sensor SE for generating a first signal which is a measure of the luminous flux of the discharge lamp. The circuit part II also comprises a circuit part IV for generating a reference signal which is a measure of the value of the luminous flux which, during stationary operation, corresponds to the second power (?) consumed by the discharge lamp. An output of the light sensor SE is connected to a first input of comparator 5, and an output of the circuit part IV is connected to a second input of comparator 5. An output of comparator 5 is connected to an input of control circuit 3 for generating a dim signal in dependence upon the first signal and the reference signal. The light sensor SE, the circuit part FIV,, the comparator 5 and the control circuit 3 jointly form both the circuit part II and a circuit part VI for controlling the luminous flux. An output of the circuit part 3 is connected to an input of the circuit part I, and an output of the circuit part V is connected to an input of circuit part II. For the rest, the structure of the example shown in FIG. 2 corresponds to the example shown in FIG. 1.

The operation of the example shown in FIG. 2 will be described hereinbelow.

If the input terminals K1 and K2 are connected to a supply voltage source, the ballast circuit B generates a lamp current which is fed to the discharge lamp La. The amplitude of the lamp current and hence the value of the power absorbed by the discharge lamp La depends upon the dim signal generated by the circuit part II. As soon as the discharge lamp has been ignited, the sensor SE generates a signal, under the influence of the light generated by the discharge lamp, which signal is a measure of the luminous flux of the discharge lamp. Circuit part IV generates a reference signal, which is a measure of the value of the luminous flux which corresponds, during stationary operation, to a second power consumed by the discharge lamp. Via the output of the comparator 5, these two signals influence the value of the dim signal generated by the control circuit 3. In this manner, the luminous flux of the discharge lamp is controlled, during the predetermined time interval, at a level which, during stationary operation of the lamp, corresponds to the second value of the power consumed by the discharge lamp, or to a second value of the dim signal. Towards the end of the predetermined time interval, both the circuit device and the discharge lamp are in stationary operating conditions. It is possible that also after the predetermined time interval has elapsed, the luminous flux of the discharge lamp is controlled in dependence upon the signal from the sensor SE and the signal from the circuit part IV. However, it is also possible to provide the circuit part 3 with, for example, a timer which sets the dim signal at the end of the predetermined time interval to the second value and, if necessary, switches off the light sensor SE, circuit part IV and the comparator 5.

A practical embodiment of the example shown in FIG. 1 was realized by means of a 8XC749 microprocessor from Philips. The ballast circuit was formed by a HF-R 158 TLD high-frequency ballast from Philips. The predetermined time interval was 60 seconds. A number of 64 successive values for the dim signal were stored in the memory. The discharge lamp was a TLD-type low-pressure mercury vapor discharge lamp from Philips having a rated power of 58 W. The second value of the power consumed by the discharge lamp was 60% of the rated lamp power. It was found that the luminous flux of the discharge lamp during the predetermined time interval differed considerably less than 10% from the luminous flux which, during stationary operation, corresponds to the second value of the power consumed by the discharge lamp.

What is claimed is:

1. A circuit device for feeding a discharge lamp, comprising input terminals for connecting the circuit device to a supply-voltage source, a ballast circuit for generating a lamp current from a supply voltage supplied by the supply-voltage source, a circuit part I, which is coupled to the ballast circuit, for controlling the power consumed by the discharge lamp in dependence upon a dim signal, a circuit part II, which is coupled to the circuit part I, for generating the dim signal, which dim signal has a first value immediately after the ignition, which value corresponds, during stationary operation, to a first value of the power consumed by the discharge lamp, and is maintained at a second value after a predetermined time interval, which value corresponds, during stationary lamp operation, to a second value of the power consumed by the discharge lamp, which second value is lower than the first value of the power consumed by the discharge lamp, a circuit part V which enables a user to set a dim signal to the second value or a third value which, during stationary lamp operation, corresponds to a third value of the power consumed by the discharge lamp, which third value is higher than the second value of the power consumed by the discharge lamp, characterized in that, during the predetermined time interval, the dim signal is adjusted by the circuit part II in such a manner that, during the predetermined time interval, the luminous flux of the discharge lamp differs less than 25% from the luminous flux which, during stationary operation, corresponds to the second power consumed by the discharge lamp.

2. A circuit device as claimed in claim 1, wherein, during the predetermined time interval, the dim signal is adapted by the circuit part II in such a manner that the luminous flux of the discharge lamp differs less than 10%, during the predetermined time interval, from the luminous flux which, during stationary operation, corresponds to the second power consumed by the discharge lamp.

3. A circuit device as claimed in claim 1, wherein the circuit part II is provided with a memory for storing dim-signal values for a number of instants in the predetermined time interval, a circuit part III for successively making the dim signal equal to the values stored in the memory.

4. A circuit device as claimed in claim 3, wherein the circuit part III comprises a microprocessor.

5. A circuit device as claimed in claim 1, wherein the circuit part II is provided with a circuit part VI for controlling the luminous flux.

6. A circuit device as claimed in claim 5, wherein the circuit part VI for controlling the luminous flux is provided with a light sensor for generating a first signal which is a measure of the luminous flux of the discharge lamp, a comparator provided with a first and a second input, the first input being coupled to the light sensor, a circuit part IV coupled to the second input of the comparator for generating a reference signal which is a measure of the value of the luminous flux which, during stationary operation, corresponds to the second power consumed by the discharge lamp, and a control circuit coupled to an output of the comparator for generating a dim signal in dependence upon the first signal and the reference signal.

7. A circuit device as claimed in claim 1, wherein the circuit part V can be activated by interrupting the supply voltage.

* * * * *